US006960317B2

(12) United States Patent
Dussud et al.

(10) Patent No.: US 6,960,317 B2
(45) Date of Patent: Nov. 1, 2005

(54) ASSEMBLY FOR CONTROLLING A STOPPER BELONGING TO A CONTINUOUS CASTING INSTALLATION, AND CORRESPONDING CONTINUOUS CASTING INSTALLATION

(75) Inventors: Michel Dussud, Saint Martin en Haut (FR); Patrick Simonnin, Ecully (FR)

(73) Assignee: Ste d'Etudes et de Realisations Techniques - S.E.R.T., Decines (FR)

( * ) Notice: Subject to any disclaimer, the term of this patent is extended or adjusted under 35 U.S.C. 154(b) by 0 days.

(21) Appl. No.: 10/721,226

(22) Filed: Nov. 26, 2003

(65) Prior Publication Data

US 2004/0108636 A1 Jun. 10, 2004

(30) Foreign Application Priority Data

Dec. 4, 2002 (FR) ..... 02 15290

(51) Int. Cl.[7] ..... B22D 41/20
(52) U.S. Cl. ..... 266/236; 222/602; 164/155.1
(58) Field of Search ..... 266/236; 222/602; 164/155.1

(56) References Cited

U.S. PATENT DOCUMENTS 4,953,761 A * 9/1990 Fishman et al. ..... 222/602
5,674,426 A 10/1997 Schmid et al.
6,358,467 B1 * 3/2002 Mordue ..... 266/235

FOREIGN PATENT DOCUMENTS

| | | |
|---|---|---|
| DE | 1139241 | 9/1992 |
| GB | 970513 | 9/1964 |
| JP | 04270049 | 2/1993 |

* cited by examiner

*Primary Examiner*—Melvyn Andrews
(74) *Attorney, Agent, or Firm*—Dowell & Dowell, P.C.

(57) ABSTRACT

A control assembly for controlling reciprocal motion of a stopper used with a tundish dish including a shaft movably guided within a guiding assembly and connected to the stopper and wherein a motor is movable between a first postion wherein output from the motor is disengaged from a motion converting device connected to the shaft and a second position wherein the motor is drivingly engaged with the motion converting device. A linking device is also provided to secure the motor relative to the motion converting device in the second position thereof.

19 Claims, 4 Drawing Sheets

ASSEMBLY FOR CONTROLLING A STOPPER BELONGING TO A CONTINUOUS CASTING INSTALLATION, AND CORRESPONDING CONTINUOUS CASTING INSTALLATION

BACKGROUND OF THE INVENTION

1. Field of the Invention

The present invention relates to an assembly for controlling a stopper belonging to a continuous casting installation, as well as to a continuous casting installation provided with such a control assembly.

2. Brief Description of the Related Art

The first step of a continuous casting operation conventionally consists in pouring molten metal into a basin, also called tundish, from a ladle. This tundish is, in addition, provided with a stopper.

When the molten metal has reached a given level in the tundish, it is then poured into a mould, under the effect of a movement of release of the stopper. This then initiates a phase of filling of the mould until a given reference level is reached.

According to a first variant, it is firstly known to start up this continuous casting manually. However, in addition to its relative lack of repetitivity, this solution requires the intervention of at least one operator.

In order to overcome these drawbacks, it has been proposed to effect the afore-mentioned start up automatically. In this spirit, the stopper is driven by means of a control assembly, also called actuator, in a stroke guaranteeing a satisfactory phase of filling of the mould.

Such an arrangement is known in particular from EP-A-0 734 801. The assembly for controlling the stopper, described in this document, comprises a drive shaft free to slide in a movement of translation with respect to a guiding assembly.

This drive shaft is fast with an intermediate arm directly supporting the stopper. A rotary servo-motor is also provided, as well as a device for converting the rotational movement, imparted by this motor, into a movement of translation of the shaft.

More precisely, this movement converting device is in the form of a screw jack. It should, moreover, be noted that the motor is offset laterally with respect to the drive shaft, with reference to the principal direction of the latter.

However, this known solution presents certain drawbacks.

For example, the assembly controlling the stopper presents relatively large dimensions. Furthermore, it is necessary to provide as many motors as guiding members, which is disadvantageous from the economic standpoint.

It is an object of the present invention to overcome the different drawbacks of the prior art set forth hereinabove.

SUMMARY OF THE INVENTION

The present invention relates to an assembly for controlling a stopper for a continuous casting installation, comprising a guiding assembly, a shaft for driving the stopper that is adapted to move in translation with respect to the guiding assembly, a motor having a rotary shaft, as well as means adapted to convert the rotational movement of the motor shaft into a movement of translation of the drive shaft, characterized in that means are provided, allowing the motor to be removably mounted on the movement converting means, with the result that the motor is selectively in a position of engagement with the movement converting means and a position spaced from the movement converting means, and in that, in the position of engagement, the rotary shaft of the motor extends substantially in a principal direction of the drive shaft.

According to other characteristics of the invention, the means to removably connect the motor are of the bayonet type. The bayonet-type fixation means comprises at least one stud, mounted on the guiding assembly, adapted to cooperate with at least one notch made in a linking piece secured to move in translation with the motor. In the position of engagement, the or each stud is received in a corresponding cavity of the notch, which cavity is bordered by an intermediate neck.

Return means are provided, particularly elastic, adapted to urge each stud axially towards the bottom of a corresponding cavity so as to prevent any untimely disconnection between the motor and the movement converting means.

The motor is received at least partly in a housing, particularly provided with handles for manually moving the motor. In the position of engagement, the housing lies approximately in line with the guiding assembly. In the position of engagement, the housing is arranged below the guiding assembly and the linking piece is mounted on said housing.

The linking piece is cylindrical and it is adapted to penetrate at least partially in a open area of the guiding assembly. The rotary shaft of the motor extends at least partially into an interior volume of said linking piece.

The movement converting means comprises a jack, particularly a screw jack, including a pin adapted to be driven in rotation by the rotary shaft of the motor, and means for temporarily drivingly engaging this pin and this shaft are provided.

The temporary means for drivingly engaging comprises two drive members adapted to mesh mutually and, in this respect, the members include intermeshing lands and grooves. Further, each member is mounted on either the pin or on the shaft.

One of the coupling members is secured to a flexible housing adapted to receive the other drive member, in the position of mutual mesh of these two members.

The invention also relates to a continuous casting installation comprising a tundish, which is adapted to receive molten metal and which is provided with an orifice ensuring flow of this molten metal, a mould disposed downstream of this orifice, so as to collect this molten metal, a stopper intended to selectively obturate this orifice, as well as an assembly for controlling this stopper, characterized in that this control assembly is as defined hereinabove.

BRIEF DESCRIPTION OF THE DRAWINGS

The invention will be described hereinafter with reference to the accompanying drawings, given solely by way of non-limiting example, in which.

DESCRIPTION OF THE PREFERRED EMBODIMENT

Figure 1:
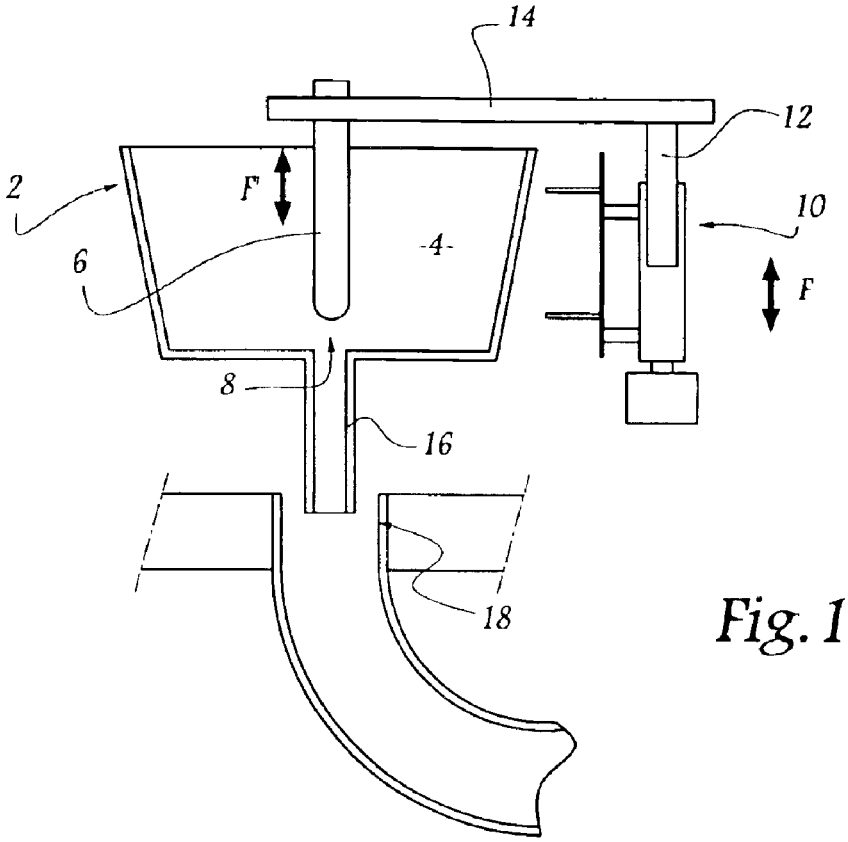
FIG. 1 is a general view illustrating a continuous casting installation according to the invention.
Figure 5:
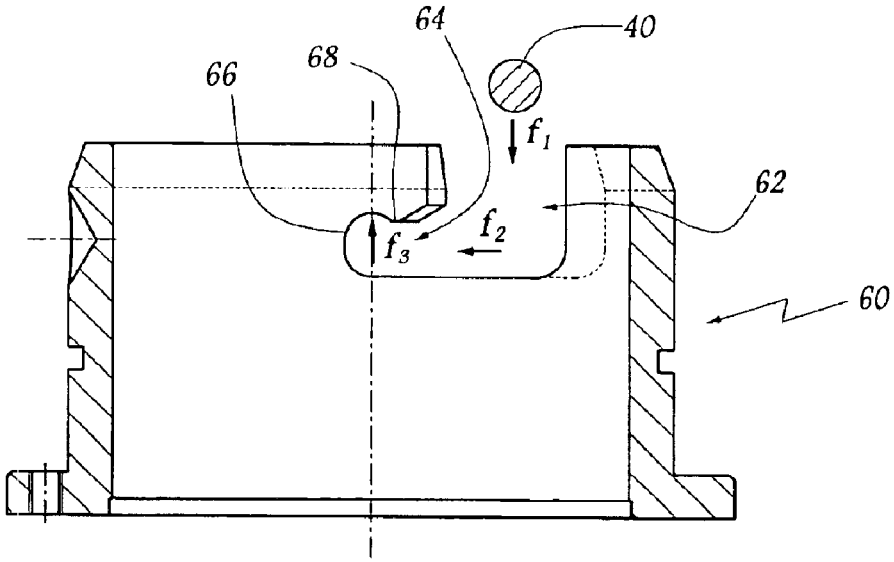
FIG. 5 is a view in longitudinal section illustrating a linking piece belonging to the control assembly of FIGS. 2 to 4.
Figure 2:
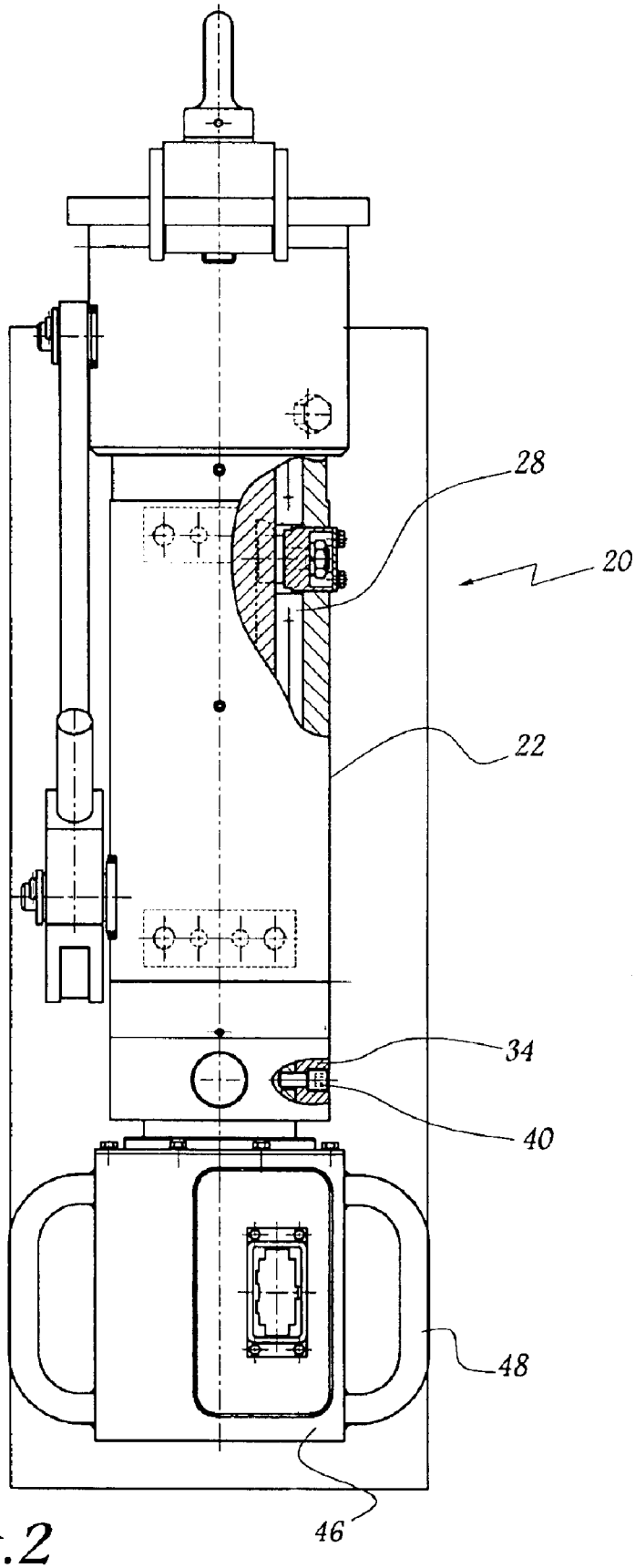
FIG. 2 is a front view illustrating a control assembly belonging to the continuous casting installation of FIG. 1.
Figure 3:
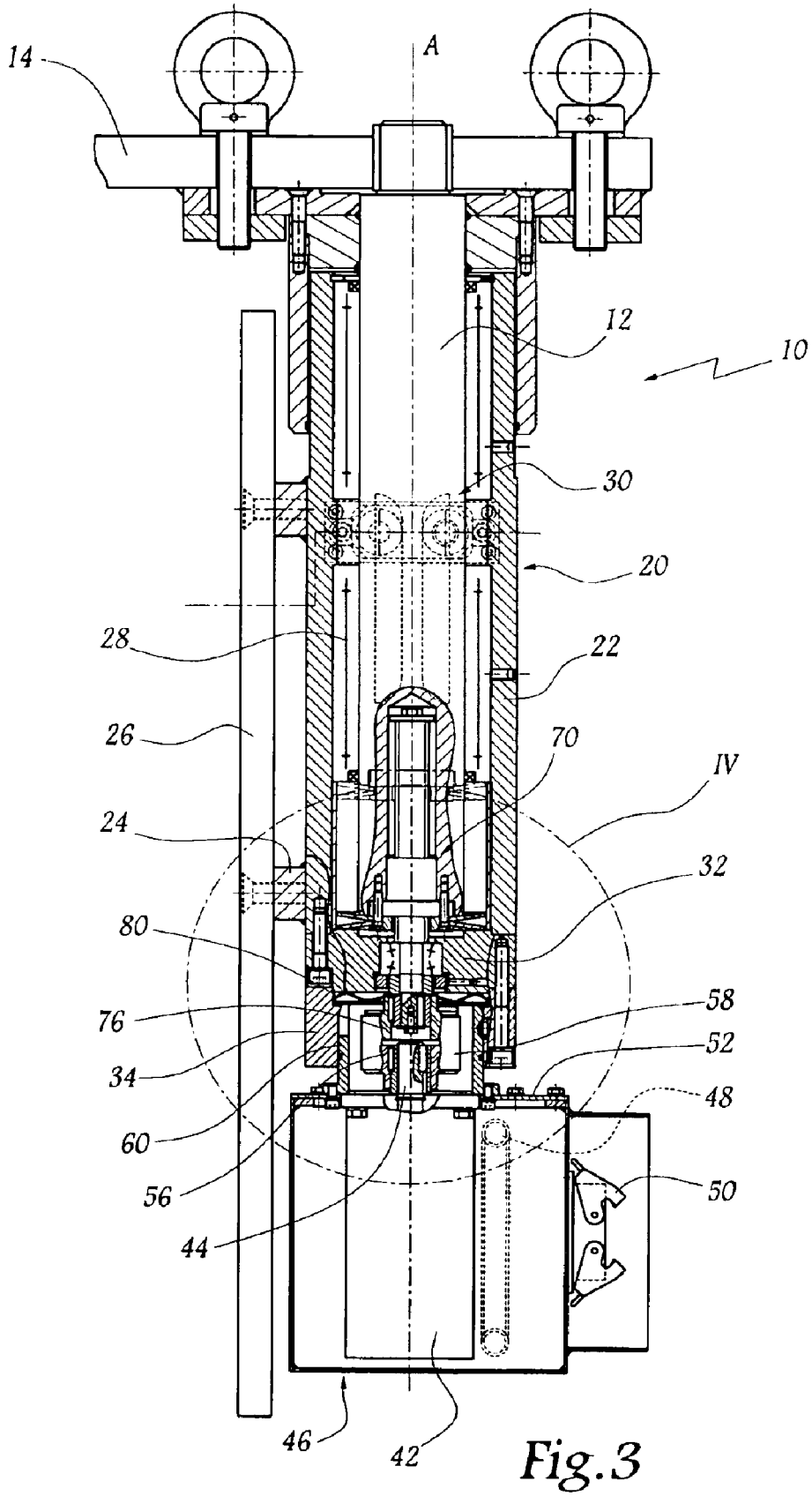
FIG. 3 is a side view in section illustrating the control assembly of FIG. 2.
Figure 4:
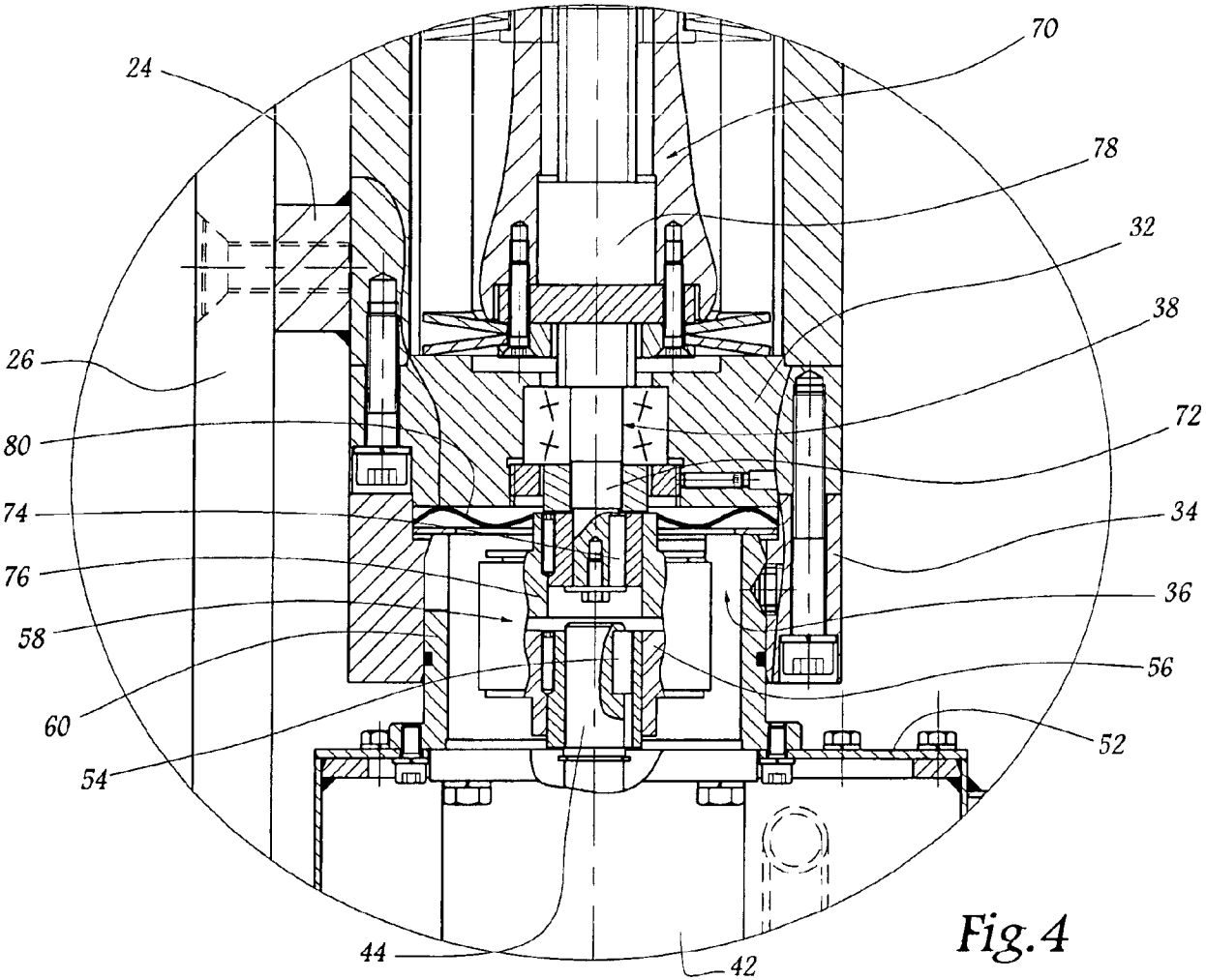
FIG. 4 is a view on a larger scale illustrating a part of this control assembly.

Referring now to the drawings, the continuous casting installation illustrated in FIG. 1 comprises a tundish 2 which is filled with molten metal 4, for example steel. The latter has been poured into the tundish from a ladle (not shown).

The bottom of this tundish is closed, in known manner, by a stopper 6 or plug, which defines a lower orifice for passage of the metal, also called a nozzle 8. This stopper may be driven along its principal axis, namely vertically in FIG. 1, via a control assembly 10, or actuator, which will be described more precisely hereinafter.

The control assembly 10 comprises in particular a drive shaft 12 which may be displaced in translation in the direction of arrow F, in the present case vertically. This movement of the shaft 12 then induces a displacement of the stopper 6, shown by vertical arrow F', via an intermediate arm 14.

The walls of the nozzle 8 are, furthermore, provided with a tube 16, made of a refractory material, which opens out in a mould 18. The latter receives a dummy bar (not shown), intended to be progressively withdrawn in order to ensure in known manner the extraction of a bar of solidified metal, likewise not shown.

FIGS. 2 to 5 illustrate the control assembly 10 in greater detail. They show the shaft 12, of which the principal axis, vertical, in the present case, is given reference A, as well as the intermediate arm 14, illustrated partially. The control assembly also comprises a fixed guiding assembly, of conventional type, which is generally designated by reference 20.

This assembly 20 has a cylindrical body 22 on which are added flanges 24 allowing the assembly to be mounted on a plate 26 secured to the tundish 2. This cylindrical body 22 contains, in manner known per Se, two ball-bearing bushes 28 as well as a device 30 conventionally preventing rotation of the shaft 12 about its vertical axis A.

The cylindrical body 22 is screwed, at its lower end, on a base 32, which is itself extended, opposite the cylindrical body, by an annular skirt 34. The latter thus defines, with the opposite walls of the base 32, an open area 36 placed in communication with a central opening 38 made axially in the base 32.

Furthermore, the walls of the skirt 34 bear studs 40 extending radially towards the inside. The function of these studs 40, which are provided to be three in number in the present case, will be explained hereinbelow.

In addition, the control assembly 10 comprises a motor 42 of conventional type, provided with a vertically extending rotary drive shaft 44. This motor is received partially in a housing 46, equipped with handles 48, as well as with a current supply 50.

This housing 46 is closed, in its upper part facing the cylindrical body 22, with a cover 52 in which is a central orifice for passage of the motor drive shaft 44. The latter is secured, via a key 54, with a first drive coupling member 56 received in a flexible housing 58, which will both be described in greater detail hereinafter.

This housing 58 is disposed in the interior volume of a linking piece or mounting collar 60, of cylindrical shape, which is secured on the motor 42 by any appropriate means. As will be shown more particularly in FIG. 5, the wall of this linking piece 60 has different notches 62 therein, which are provided in a number corresponding to that of the studs 40.

More precisely, each notch 62, which is substantially in the form of an L, opens at the end of the linking piece 60 opposite the cover. This notch extends in a arcuate groove 64 which defines an end cavity 66, bordered by an intermediate neck 68.

The control assembly also comprises means for converting the rotational movement of the motor drive shaft 44 into a movement of translation of the shaft 12.

More precisely, these means comprise a screw jack 70, known per se, which is housed principally in the cylindrical body 22 of the guiding assembly 20. A pin 72 of this jack 70, which traverses the base 32, is secured, via a key 74, with a second drive coupling member 76. This pin 72 which may be driven by the shaft 44 of the motor 42, is adapted to cooperate, in conventional manner, with a nut 78 secured to the drive shaft 12.

The two coupling members 56 and 76 include intermeshing lands and gooves. In service, the lands of one of the two members conventionally penetrate in the gooves or recesses of the other, with the result that there is a temporary coupling, with disengagement being possible, between these two members 56 and 76.

It should be noted that member 56 is permanently housed in the flexible housing 58, while member 76 is adapted to extend into this housing temporarily. Finally, an elastic element 80 is provided, in the present case a spring lock washer, to urge or return the coupling member 76 downwardly.

Functioning of the control assembly 10 described hereinabove will now be explained.

When the motor 42 is disconnected from the drive shaft 12, the operator has available, on the one hand, the aforementioned motor, which is housed in its housing 46 provided with the handles 48 for manual manipulation, the intermeshing drive coupling member 56 being accessible. On the other hand, the other intermeshing drive coupling member 76, at the lower end of the pin of the jack 70, is also accessible.

The housing 46 is then manipulated, thanks to the handles 48, in a substantially upwardly directed movement of translation, so as firstly to engage the linking piece 60 in the open area 36.

During this translation, it may become necessary to give a slight rotation to the motor housing, close to some degrees, to ensure the alignment of the two intermeshing drive coupling members 56 and 76. Consequently, the member 76 is then received in the interior of the supple housing 58, itself secured to the first drive coupling member 56.

Then, the upward translation of the housing 46 continuing, the studs 40 are received in the vicinity of the openings of the different notches 62, provided in the linking piece 60. Rotation of the housing 46 allows the studs 40 to be moved relative to the notches, in the direction of arrow $f_1$ shown in FIG. 5.

When the studs come into axial abutment against the walls of the notches 62, the housing 46 is pivoted. This induces an advance of the studs 40 along the grooves 64, in the direction of arrow $f_2$ shown in FIG. 5.

At the end of this movement of pivoting, each stud 40 is received in a corresponding cavity 66, after having passed relative to an intermediate neck 68. It should be noted that the spring washer 80 provides a force to urge each stud 40 to the bottom of the cavity 66, in the direction of arrow $f_3$ of this same FIG. 5. This thus prevents any untimely emergence of the studs 40 from the cavities 66.

In this way, the motor 42 may be removably connected to the pin 72 of the screw jack 70. Consequently, the motor has two positions, namely a position of engagement, in which the two drive coupling members 56 and 76 are intermeshed, and a disconnected position, in which the afore-mentioned drive coupling members are spaced from each other.

Furthermore, in the example described and shown, the means for mounting the motor 42 on this jack 70 are of a bayonet type. In effect, it requires a movement of translation with the motor housing being moved upwardly, combined with a movement of rotation of the motor housing with respect to this jack to seat the studs 40 within the cavities of the notches.

In service, in the position of engagement set forth hereinabove, the drive shaft 44 of the motor 42 drives the shaft 12, via the movement converting means, which comprise the two drive coupling members 56 and 76, as well as the screw jack 70. In this position of engagement, the rotary shaft 44 of the motor 42 extends substantially along the principal axis A of the drive shaft 12.

Furthermore, the housing 46, in which the motor 42 is received, is located below the cylindrical body 22, substantially in line therewith. This is advantageous, in terms of compactness of the assembly 10 controlling the stopper 6.

Finally, it should be noted that this control assembly 10 is provided with a lever (not shown), conventionally intended for moving the drive shaft 12 by hand. This is to be compared with the teaching of EP-A-0 734 801, in which the device for manually driving the stopper is constituted by a wheel coupled to a spindle.

Such a system cannot be used in casting, as the speed of displacement of the stopper is very limited. It is thus impossible to effect a manual start up of a casting with such a device, being given that the initial opening of the stopper, of the order of 15 to 20 mm, during start up, must be effected in less than a second.

This invention makes it possible to attain the objects set forth hereinabove.

In effect, as has been seen hereinabove, the compactness of the control assembly according to the invention is noteworthy in service. This is to be compared with the prior art in which the motor is offset laterally with respect to the guiding assembly.

Furthermore, the means for removably mounting or connecting the motor on the screw jack permits the latter to be rapidly disconnected.

Consequently, it is not necessary to have available as many motors as guiding assemblies, the motor being reserved solely for the step of casting. In other words, the guiding assemblies which are located at other stations of the continuous casting, such as assembly, dismantling, preheating or cooling, do not need to be provided with a corresponding motor.

The latter measure thus appears particularly advantageous, from the economic standpoint.

Finally, in the arrangement of the invention, emergency closure of the stopper is effected by gravity, upon simple deactivation of the motor. The weight of the mobile system, comprising the shaft, the arm and the stopper, thus suffices to cause the stopper to descend so as to allow such an emergency closure.

This is to be compared with EP-A-0 734 801 in which an electric resource by accumulation is employed, which operates the whole motorized chain, namely the electronic control device, the cables, the motor and the spindle.

Breakdown of one of these members, such as the tearing of a cable or a motor breakdown, thus renders any emergency closure impossible.

What is claimed is:

1. A control assembly for controlling reciprocal movement of a stopper relative to an orifice of a tundish for a continuous casting installation, the control assembly comprising; a shaft reciprocally mounted in a guiding assembly, means for connecting the shaft to the stopper to reciprocally move the stopper with the shaft, a motor, having a rotary drive shaft, motion converting means connected to the shaft and being selectively drivingly engageable with the motor drive shaft to convert a rotational movement of the motor drive shaft into a reciprocal movement of the shaft, means for mounting the motor so as to be relatively movable between a first rest position wherein the rotary drive shaft is disengaged relative to the motion converting means to a second position wherein the rotary drive shaft is drivingly connected with the motion converting means, and wherein, in the second engaged position, the rotary drive shaft of the motor extends substantially in a principal direction of reciprocation of the shaft.

2. The control assembly of claim 1, including means for securing the motor in the second engaged position.

3. The control assembly of claim 2, wherein the means for securing includes at least one stud mounted on the guiding assembly, that cooperatively seats within at least one notch made in a linking piece that is fixed to move with the motor.

4. The control assembly of claim 3, wherein, when the motor is in the second position and secured, said at least stud is received in a cavity of the at least one notch, which cavity is bordered by an intermediate neck that prevents relative rotation of the at least one stud with respect to the at least one notch unless a force is applied to move the motor relative to an elongated central axis of the guiding assembly.

5. The control assembly of claim 4, including means for resiliently urging the at least one stud to remain within the cavity of the at least one notch.

6. The control assembly of claim 1, wherein the motor is at least partially mounted in a housing, provided with handles for moving the motor between the first and second positions.

7. The control assembly of claim 6, wherein, in the second position, the housing lies approximately in line with the guiding assembly.

8. The control assembly of claim 7, wherein, in the second position, the housing is mounted vertically below the guiding assembly.

9. The control assembly of claim 3, wherein the linking piece is mounted on a housing in which the motor is at least partially mounted.

10. The control assembly of claim 3, wherein the linking piece is a cylindrical sleeve that is cooperatively movable within a cavity of the guiding assembly.

11. The control assembly of claim 10, wherein the rotary drive shaft of the motor extends at least partially in an interior volume of the cylindrical sleeve.

12. The control assembly of claim 1, wherein the motion converting means includes a screw jack, including a pin adapted to be driven in rotation by input from the rotary drive shaft of the motor, and means for temporarily coupling the pin and the rotary drive shaft of the motor together.

13. The control assembly of claim 12, wherein the means for temporary coupling includes first and second drive coupling members that are brought into intermeshing relationship with one another when the motor is in the second position, the first drive coupling member being operably connected to the rotary drive shaft of the motor and the second drive coupling member being operably connected to the pin of the screw jack.

14. The control assembly of claim 13, wherein the first and second drive coupling members include intermeshing lands and gooves.

15. The control assembly of claim 13, wherein one of the first and second drive coupling members is mounted to a flexible housing that receives the other coupling member when the first and second coupling members are intermeshed with one another.

16. A continuous casting installation comprising; a tundish that is adapted to receive molten metal and which is provided with an orifice through which the molten metal flows to a mold disposed downstream of the orifice, a stopper for selectively closing the orifice, a control assembly for controlling movement of the stopper, the control assembly including a shaft reciprocally mounted in a guiding assembly, means for connecting the shaft to the stopper to reciprocally move the stopper with the shaft, a motor having a rotary drive shaft, motion converting means connected to the shaft and being selectively drivingly engageable with the motor drive shaft to convert a rotational movement of the motor drive shaft into a reciprocal movement of the shaft, means for mounting the motor so as to be relatively movable between a first rest position wherein the rotary drive shaft is drivingly disengaged relative to the motion converting means to a second position wherein the rotary drive shaft is drivingly connected to the motion converting means, and wherein , in the second engaged position, the rotary drive shaft of the motor extends substantially in a principal direction of reciprocation of the shaft.

17. The continuous casting installation of claim 16 wherein the control assembly includes means for securing includes at least one stud mounted on the guiding assembly that cooperatively seats within at least one notch made in a linking piece that is fixed to move with the motor.

18. The continuous casting installation of claim 16 wherein the motion converting means includes a screw jack including a pin adapted to be driven in rotation by input from the rotary drive shaft of the motor, and means for temporarily coupling the pin and the rotary drive shaft of the motor together.

19. The continuous casting installation of claim 18 wherein the means for temporary coupling includes first and second drive coupling members that are brought into intermeshing relationship with one another when the motor is in the second position, the first drive coupling member being operably connected to the rotary drive shaft of the motor and the second drive coupling member being operably connected to the pin of the screw jack.

* * * * *